United States Patent [19]

Braathen

[11] 3,962,560

[45] June 8, 1976

[54] WATER HEATER

[76] Inventor: Chris Reidar Braathen, Melkeveien 55, Oslo 3, Norway

[22] Filed: Sept. 4, 1974

[21] Appl. No.: 503,063

[30] Foreign Application Priority Data

Jan. 4, 1974 Norway ..... 32/74

[52] U.S. Cl. ..... 219/314; 219/216

[51] Int. Cl.² ..... F24H 1/20

[58] Field of Search ..... 219/312, 314–316; 122/223, 234, 491; 126/361

[56] References Cited

UNITED STATES PATENTS

| | | | |
|---|---|---|---|
| 1,653,672 | 12/1927 | Shriner | 219/314 |
| 1,880,255 | 10/1932 | Johnson | 219/314 |
| 2,151,854 | 3/1939 | Knapp | 219/314 |
| 2,375,871 | 5/1945 | Reifenberg | 219/316 |
| 2,478,836 | 8/1949 | Riley | 219/314 |
| 2,643,322 | 6/1953 | Lime et al. | 219/314 |
| 2,779,855 | 1/1957 | Sawyer | 219/315 X |
| 3,484,580 | 12/1969 | Morgan | 219/314 |

FOREIGN PATENTS OR APPLICATIONS

| | | | |
|---|---|---|---|
| 21,676 | 3/1936 | Australia | 219/314 |
| 15,458 | 5/1929 | Australia | 219/314 |

*Primary Examiner*—C. L. Albritton

*Attorney, Agent, or Firm*—Burns, Doane, Swecker & Mathis

[57] ABSTRACT

Water heater which container is provided with an essentially horizontal partition wall with at least one opening which forms communication between an upper compartment for consumption water and a lower compartment for storage water surrounding a heating element. The pressure inlet and outlet are formed in the upper compartment.

8 Claims, 7 Drawing Figures

WATER HEATER

The invention relates to a water heater comprising a heat-insulated container having direct inlet from a pressure water pipe and outlet for hot pressure water, an electric heating element being arranged in a water storage tank which is in open communication with the water for consumption in the container.

The object of a construction of this type is to prevent the heating element, which operates with high surface temperature, from being subjected to rapid corrosion due to acid, aggressive water. With lime-containing water, the lime is deposited on the casing of the heating element and isolates this from the water, which means that the element cannot give off sufficient heat and is therefore burnt up. Frequent replacement of the heating element is therefore necessary.

Thus, in a known water heater of this type, a pressure-proof outer casing is provided which surrounds the actual consumption water container and the said casing is openly connected at the bottom thereof with the bottom of the consumption water container. This results in good heat transference between the consumption water and the water in the casing and substantially no replacement of the water in the casing, however, since the casing wall consists of conventional steel and has no protective stainless steel jacket as with the consumption water container, it is attacked by oxygen in the water which diffuses from the consumption water container through the connection to the casing water. A construction with rust-proof jacket in the casing, i.e. externally on the consumption water container and internally in the casing, causes complications and relatively great expense.

In another known heater, a plastic bag or plastic balloon with through-flow openings is arranged around the heating element in the container, an outer casing being thereby unnecessary, however, in order to provide adequate heat yield from the water in the bag to the consumption water, there must be a substantial through-flow of water in the bag and this undoubtedly leads to attack on the heating element.

The object of the invention is to provide an improved water heater of the type described hereinabove, the advantages of the known embodiments being retained and the disadvantages eliminated.

According to the invention, this is achieved in that the container is provided in the lower part thereof with a substantially horizontal partition wall having at least one opening which forms communication between an upper compartment for the consumption water and a lower compartment for the storage water surrounding the heating element.

Preferably, the opening or openings in the partition wall are provided with an upwardly directed upwardly open pipe having a volume which is at least sufficient to receive the volume of heat expansion of the storage water.

Optionally, the opening or openings may be provided with a downwardly directed, downwardly open pipe having a volume which is sufficient to receive the volume of heat expansion of the storage water.

By water heater of the last mentioned type, having a pipe the volume of which is sufficient to receive the volume of the heat expanded storage water, there might occur a gradual exchange of the storage water which may lead to destruction of the heating element. The reason for this exchange is so called "one-pipe-circulation" in the pipe as the storage water in the pipe has a higher temperature than the consumption water outside the pipe, so that the central part of the water in the pipe has higher temperature than the water in the pipe in contact with the wall of the pipe, and therefore rising up through the open end of the pipe into the consumption water, while consumption water will descend along the inside wall of the pipe.

A further object of the invention is therefore to hinder that storage water leave the open end of the pipe.

This is according to the invention achieved in that the pipe at top is provided with a downwardly directed expansion.

Some embodiment examples of the invention are further described hereinbelow with reference to the drawings.

Figure 1:
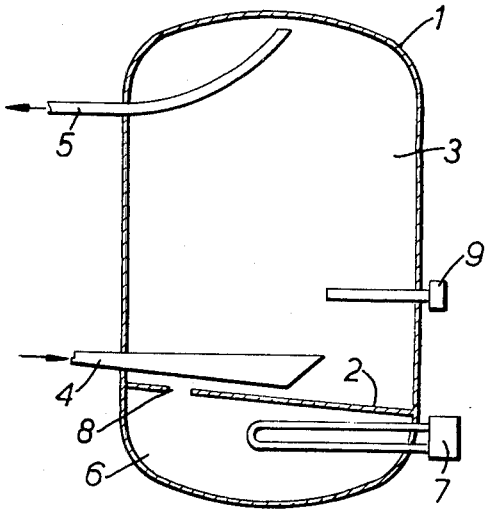
FIG. 1 illustrates diagrammatically a first embodiment of a water heater according to the invention.

The water heater of FIG. 1 has a pressure container 1 with a substantially horizontal partition wall 2 in the lower part of the container. The partition wall 2 divides the container into an upper compartment 3 for consumption water, with a cold water inlet 4 in the lower part of the compartment 3 and a water outlet 5 in the upper part of the compartment 3, and a lower compartment 6 for the storage water, with a heating element 7. The partition wall 2 has an opening 8 which forms an open connection between the consumption water compartment 3 and the storage water compartment 6. A thermostat 9 is arranged in the consumption water compartment 3. In this manner, there is relatively little replacement of water in the storage water compartment 6 and thereby little attack on the casing of the water heating element 7.

Figure 2:
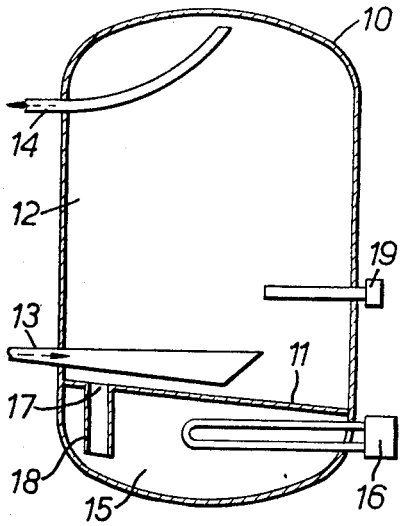
FIG. 2 illustrates diagrammatically a second embodiment example of a water heater according to the invention.

This may be improved as illustrated on FIG. 2 where the partition wall 11 of the container 10 in communication with the opening 17 is provided with a pipe 18 which is directed downwardly and is open at the lower end thereof. Water from cold water inlet 13 in the upper compartment 12 will then only to a slight degree be mixed with the water in the storage water compartment 15, since most of the heat expansion volume of this water will be received in the pipe 18. The heating element 16 is arranged in the compartment 15, while the water outlet 14 and thermostat 19 are arranged in the compartment 12.

Figure 3:
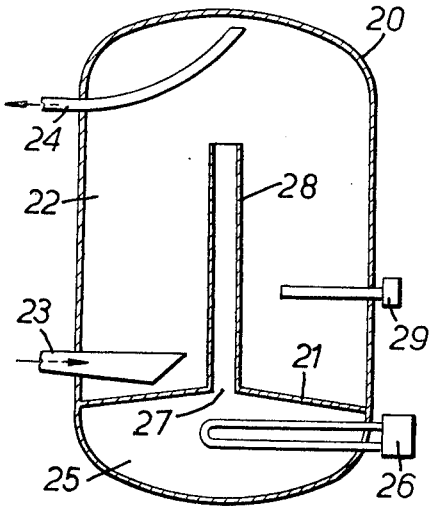
FIG. 3 illustrates diagrammatically a third embodiment example of a water heater according to the invention.

A further improvement is achieved by the water heater of FIG. 3, where the partition wall 21 of the container 20 in communication with the opening 27 has an upwardly directed pipe 28 which is open in the upper end thereof. The water from the cold water inlet 23 in the upper compartment 22 will then be substantially unable to mix with the water in the storage water compartment 25, since the volume of the pipe 28 receives at least the volume of heat expansion of the water in the storage water compartment 25. The heating element 26 in the said compartment is therefore substantially free from attack after the compartment 25 has been filled with storage water. In the upper compartment 22, the hot water outlet 24 is arranged at the top and the thermostat 29 at the bottom.

Figure 4:
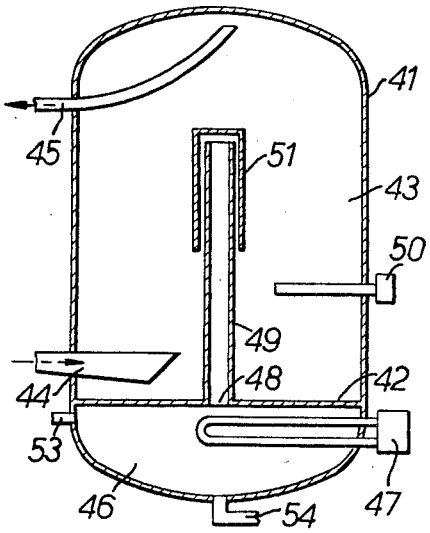
FIG. 4 illustrates diagrammatically a fourth embodiment example of a water heater according to the invention.
Figure 5:
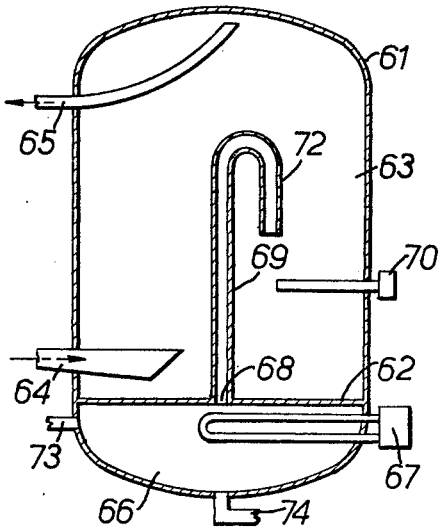
FIG. 5 illustrates diagrammatically a fifth embodiment example of a water heater according to the invention.

A further improvement is achieved by the water heater of FIGS. 4 and 5, where the pipe 49 and 69 respectively, are provided with a downwardly directed extension 51 and 72.

Figure 6:
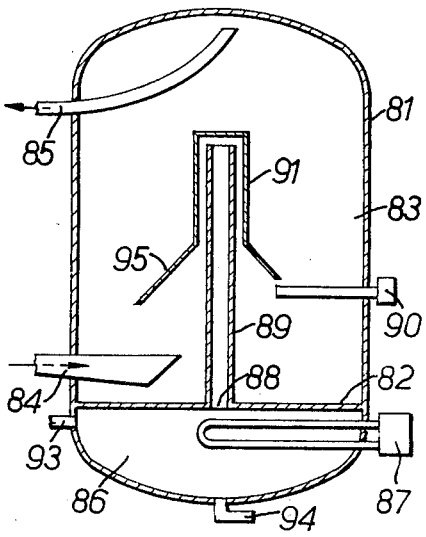
FIG. 6 illustrates diagrammatically a sixth embodiment example of a water heater according to the invention.
Figure 7:
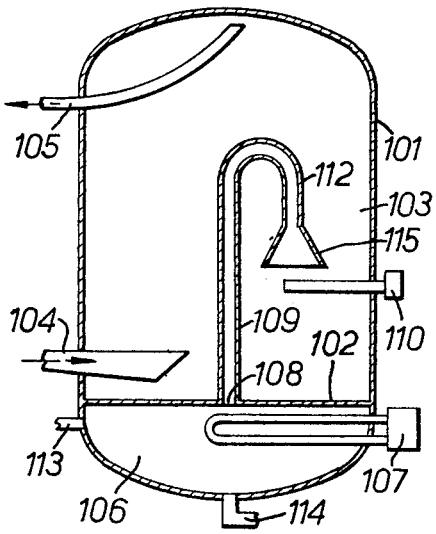
FIG. 7 illustrates diagrammatically a seventh embodiment example of a water heater according to the invention.

A still further improvement is achieved by the water heater of FIGS. 6 and 7, where the downwardly directed open end of the extension 91 and 112 respectively are provided with conical screen 95 and 115 respectively, the open wide end of which is directed downwardly.

Having described my invention, I claim:

1. Water heater comprising a heat-insulated container having direct inlet from a pressure water pipe and outlet for hot pressure water, and an electric heating element for heating water in said container, characterized in that:

said container, in the lower part thereof, is provided with an essentially horizontal partition wall which separates the container into an upper compartment and a lower compartment, said compartments being substantially co-extensive in a horizontal direction;

said wall having at least one opening which establishes communication between said upper compartment and said lower compartment;

said heating element being disposed in said lower compartment so as to be submersed in water contained therein;

said inlet and said outlet both being formed in said upper compartment, such that water in said upper compartment constitutes consumption water and water in said lower compartment constitutes storage water surrounding said heating element.

2. Water heater according to claim 1, characterized in that said at least one opening in the partition wall is provided with a downwardly directed downwardly open pipe having a volume which is sufficient to receive the volume of heat expansion of the storage water.

3. Water heater according to claim 1, characterized in that said at least one opening in the partition wall is provided with an upwardly directed, upwardly open pipe with a volume which is at least sufficient to receive the volume of heat expansion of the storage water.

4. Water heater according to claim 3, characterized in that the pipe at top is provided with a downwardly directed extension.

5. Water heater according to claim 4, characterized in that the extension is an upwardly closed cap arranged with passage over the end of the pipe and the skirt of which extending downwardly along the pipe and forming the open end of the extension.

6. Water heater according to claim 4, characterized in that the extension is formed by the open end of the pipe being bent 180° so that the open end is extending downwardly.

7. Water heater according to claim 5, characterized in that the open downwardly directed end of the cap is provided with a conical screen the open wide end of which is directed downwardly.

8. Water heater according to claim 6, characterized in that the downwardly directed open end of the pipe is provided with a conical screen the open wide end of which is directed downwardly.

* * * * *